US008056873B1

(12) United States Patent
Hanley et al.

(10) Patent No.: US 8,056,873 B1
(45) Date of Patent: Nov. 15, 2011

(54) TOOL-LESS DOUBLE CURTAIN ROD ASSEMBLY

(75) Inventors: Michael P. Hanley, Smithfield, RI (US); Mary Woodhouse, Cranston, RI (US)

(73) Assignee: Kenney Manufacturing Company, Warwick, RI (US)

( * ) Notice: Subject to any disclaimer, the term of this patent is extended or adjusted under 35 U.S.C. 154(b) by 0 days.

(21) Appl. No.: 12/257,021

(22) Filed: Oct. 23, 2008

Related U.S. Application Data

(60) Provisional application No. 60/985,413, filed on Nov. 5, 2007.

(51) Int. Cl.
*A47H 1/10* (2006.01)

(52) U.S. Cl. ..... 248/264; 248/261

(58) Field of Classification Search ..... 248/252, 248/251, 254–272, 200.1
See application file for complete search history.

(56) References Cited

U.S. PATENT DOCUMENTS

| | | | | | |
|---|---|---|---|---|---|
| 956,983 | A * | 5/1910 | Laun | 248/264 |
| 1,564,747 | A * | 12/1925 | Barrett | 248/262 |
| 1,594,268 | A * | 7/1926 | Machowicz | 248/256 |
| 1,720,308 | A * | 7/1929 | Vogt | 248/261 |
| 2,032,842 | A * | 3/1936 | Gould | 211/105.6 |
| 2,455,640 | A * | 12/1948 | Ashbaugh | 38/102.8 |
| 4,793,646 | A * | 12/1988 | Michaud, Jr. | 294/19.1 |
| 5,011,030 | A * | 4/1991 | Alaurent | 211/105.6 |
| 5,375,938 | A * | 12/1994 | Bartlow | 403/202 |
| 6,854,916 | B2 * | 2/2005 | Hsieh | 403/109.3 |
| 7,089,988 | B2 * | 8/2006 | Coleman | 160/168.1 R |
| 2004/0182806 | A1 * | 9/2004 | Figueroa | 211/105.4 |

FOREIGN PATENT DOCUMENTS

GB 2050465 A * 1/1981

OTHER PUBLICATIONS

Michael Hanley, "Declaration" Apr. 4, 2011.

* cited by examiner

*Primary Examiner* — Terrell McKinnon
*Assistant Examiner* — Erin W Smith
(74) *Attorney, Agent, or Firm* — Charles Nessler

(57) ABSTRACT

A curtain rod assembly for a window having a window casement is disclosed. The curtain rod assembly includes left and right brackets. Each bracket has a curtain rod support extending therefrom. An adjustable support rod is coupled to the left and right brackets. The adjustable support rod is configured and arranged to brace the left bracket and the right bracket against the window casement. A decorative curtain rod is suspended between the curtain rod supports.

10 Claims, 8 Drawing Sheets

TOOL-LESS DOUBLE CURTAIN ROD ASSEMBLY

CROSS-REFERENCE TO RELATED APPLICATION

The present patent document claims priority to earlier filed U.S. Provisional Patent Application Ser. No. 60/985,413, filed Nov. 5, 2007, and U.S. Design Patent Application Ser. No. 29/324,228, filed Sep. 9, 2008, the entire contents of which are incorporated herein by reference.

BACKGROUND OF THE INVENTION

1. Field of the Invention

The present invention relates generally to curtain rods and more specifically to a curtain rod that does not require tools or permanent mounting hardware, such as screws or nails, to attach to a window casement.

2. Background of the Related Art

Curtain rods that require no mounting hardware and that are frictionally fit within a window casement, commonly known as spring tension rods, are known in the art. These rods are desirable to consumers because they require little or no skill or tools to install, and installation is frequently damage-free to the window casement. However, these prior art spring tension rods require the use of spring-tension to form the tight friction fit within the window casement. The disadvantage to using a spring-tension rod is that fact that, over time, the rod slips down the window casement or even falls out of the window casement entirely. As a consequence, the consumer needs to periodically adjust and reinstall the spring tension rods to correct the misalignment due to this slippage. Accordingly, it would desirable in the art to have a tool-less curtain rod that minimizes slipping, yet still retains the known advantages of prior art tool-less curtain rods

SUMMARY OF THE INVENTION

The tool-less curtain rod assembly of the present invention solved the problems of the prior art by providing a tool-less curtain rod that includes a pair of mounting brackets with an adjustable support rod that is rigid and does not rely on spring-tension to keep the assembly from slipping or falling from a window casement. In particular, the adjustable support rod includes a novel gross and fine adjustment mechanism which permits the adjustable support rod to be tightened against the window casement. The brackets also include a depending stabilizer portion which resists twisting forces applied to the bracket via the weight of a curtain rod and curtain mounted on hooks extending from the brackets.

Although there are tool-less single curtain rods in the prior art that project from the window casement, those products do not hold very much weight and are intended only to be used in wood casings. The tool-less curtain rod assembly of the present invention, however, can hold much more weight than such prior art spring tension type rods.

Moreover, the tool-less curtain rod assembly of the present invention may also be used to hold two layers of drapery treatments, a common window decorating approach. Prior art double curtain rods, however, are not tool-less.

BRIEF DESCRIPTION OF THE DRAWINGS

These and other features, aspects, and advantages of the present invention will become better understood with reference to the following description, appended claims, and accompanying drawings where:

DESCRIPTION OF THE PREFERRED EMBODIMENT

Figure 1:
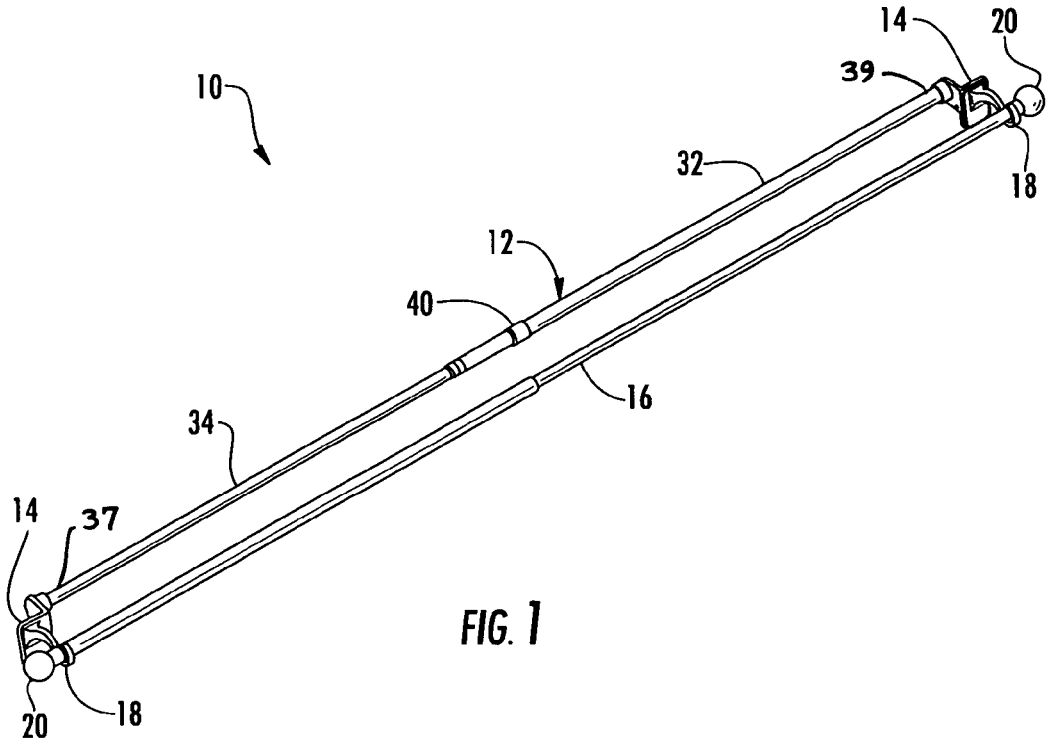
FIG. 1 is a perspective view of a preferred embodiment of a tool-less double curtain rod.
Figure 2:
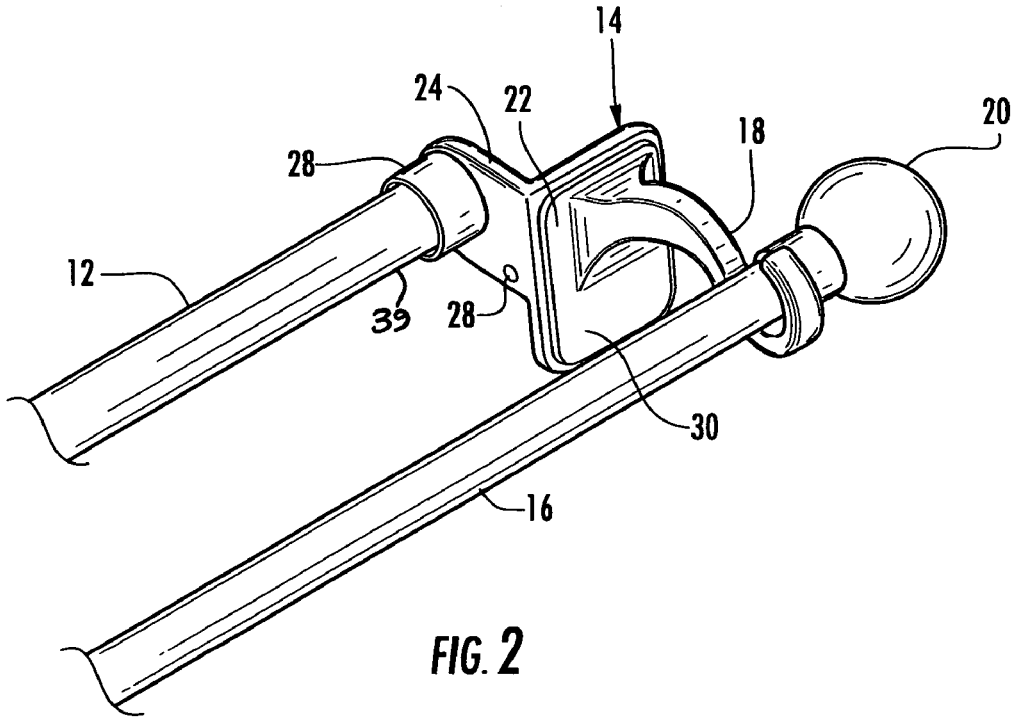
FIG. 2 is a close up view of one end of the preferred embodiment of the tool-less double curtain rod.

Referring to FIG. 1, the tool-less double curtain rod assembly is shown generally at 10. The tool-less double rod assembly 10 generally includes an adjustable support rod 12, two brackets 14 and a decorative curtain rod 16. The adjustable support rod 12 may also serve as a second curtain rod-tee. As will be described in greater detail below, the brackets 14 are configured to be held in place against the opposing vertical interior sides of a window casement (not shown) by the adjustable support rod 12 and are also configured to removably hold the decorative curtain rod 16 as shown in FIG. 2. The decorative curtain rod 16 may preferably telescope to a desired length to fit within hooks 18 of the brackets 14. The decorative curtain rod 16 may also include a pair of finials 20 extending from either end to accent the entire assembly 10. Alternatively, a fixed length curtain rod or curtain rod cut to fit the desired length may also be used in place of an adjustable curtain rod 16.

Figure 3:
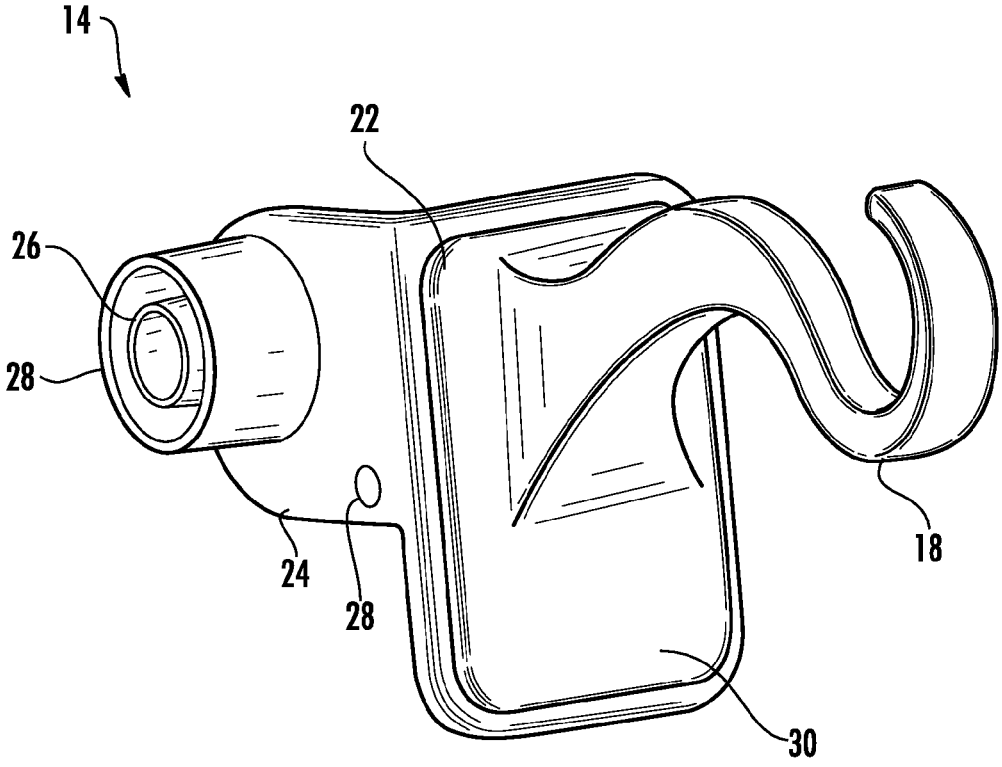
FIG. 3 is a perspective view of the right bracket, it being understood that the left bracket is the mirror image thereof.

Referring to FIG. 3, a right side bracket 14 is shown. The left bracket is the mirror image of the right bracket 14. Each bracket 14 includes a forward portion 22 with a curtain rod hook 18 extending therefrom. The hook 18 may also include a set screw (not shown), which may or may not include a decorative head, for tightening against the decorative curtain rod 16 in order to selectively lock the decorative curtain rod 16 within the hook 18.

A side portion 24 extends rearwardly and perpendicularly from the front portion 22 and includes an inner holding structure 26 and an outer holding structure 28 for holding the adjustable support rod 12. The side portion 24 may also include an aperture 28 formed thereon to receive a fastener to more securely attach the bracket 14 to the window casement.

Extending downwardly from the front portion 22 is a stabilizer portion 30. The stabilizer portion 30 prevents twisting of the bracket 14 against the window casement when the hook 18 is loaded with a curtain rod 16 with a curtain or drape supported thereon.

Referring again to FIG. 1, the adjustable support rod 12 includes an outer tubular portion, or part, 32 and a smaller diameter inner tubular portion, or part, 34. As the drawings show, the tubular portions are round in cross section. Each tubular portion 32, 34 includes an inward facing end and an outward facing end. The inward facing end of the inner tubular portion 34 is slidably received within the inward facing end 33 of the outer tubular portion 32, thus forming a tubular part subassembly. The subassembly allows the length of adjustable support rod 12 to be grossly adjusted to fit the size of a window casement, by slidably adjusting how much of the inner tubular portion 34 is within the outer tubular portion 32. The grossly adjusted length of rod 12 or two fitted-together tubular parts 32, 34 is determined by which selected aperture 36 the tab 35 of finger 38 engages, as described next. A finger with tab and engagement of the tab with an aperture comprises a means for grossly adjusting the length of the support rod; alternatively stated, a gross adjustment mechanism.

Figure 4:
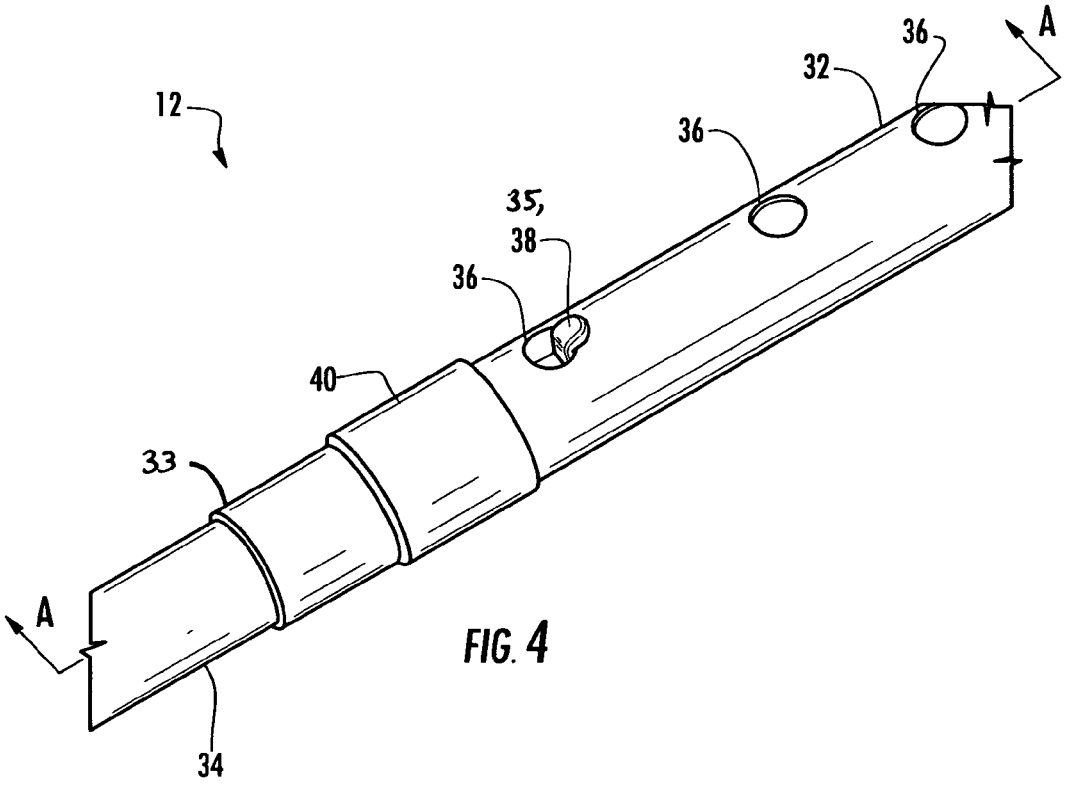
FIG. 4 is a close up view of the latching mechanism for the adjustable support rod.
Figure 5:
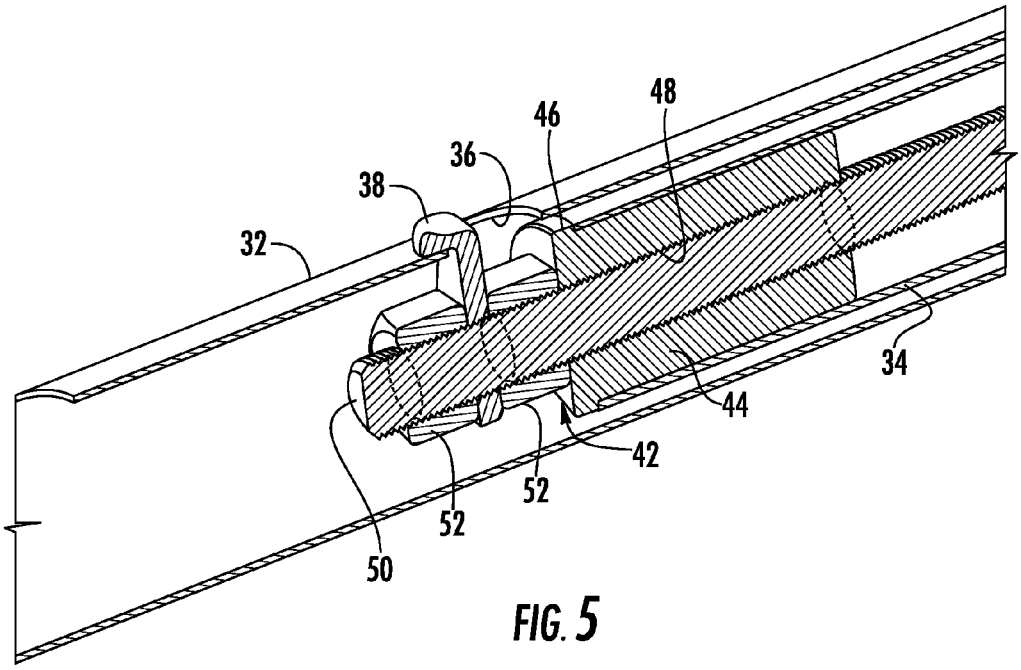
FIG. 5 is a cross-section view showing how the fine adjustment mechanism is positioned within the adjustable support rod.

Referring to FIG. 4, the outer tubular portion 32 includes several lengthwise-spaced apart apertures 36, configured to receive tab 35 of locking finger 38. Finger 38 is connected indirectly to the end of the inner tubular portion 34, as shown in FIG. 5, and described further below. Sleeve 40 is fitted around the outer tubular portion 32. During use, the sleeve 40 is drawn over tab 35 of the locking finger 38, where it protrudes through one of the apertures 36 on the outer tubular portion 32, to prevent a curtain from snagging on the locking finger tab.

The outward facing ends 37, 39, respectively, of the inner tubular portion 34 and outer tubular portion 32 of the adjustable support rod 12 are configured to be received within the holding structures 26, 28 on the brackets 14. FIG. 2 shows the outer end of the outer tubular portion 34 as it is received within the outer holding structure 28 on the bracket 14. The outward facing end 37 of the inner tubular portion 34 is received within the inner holding structure 26 in a similar manner. See FIG. 1. Although the ends of the adjustable support rod 12 are shown being received within the holding structures 26, 28, this arrangement could easily be reversed with the holding structures 26, 28 being configured to be inserted into the outward facing ends of the tubular portions 32, 34 of the adjustable support rod 12.

Figure 6:
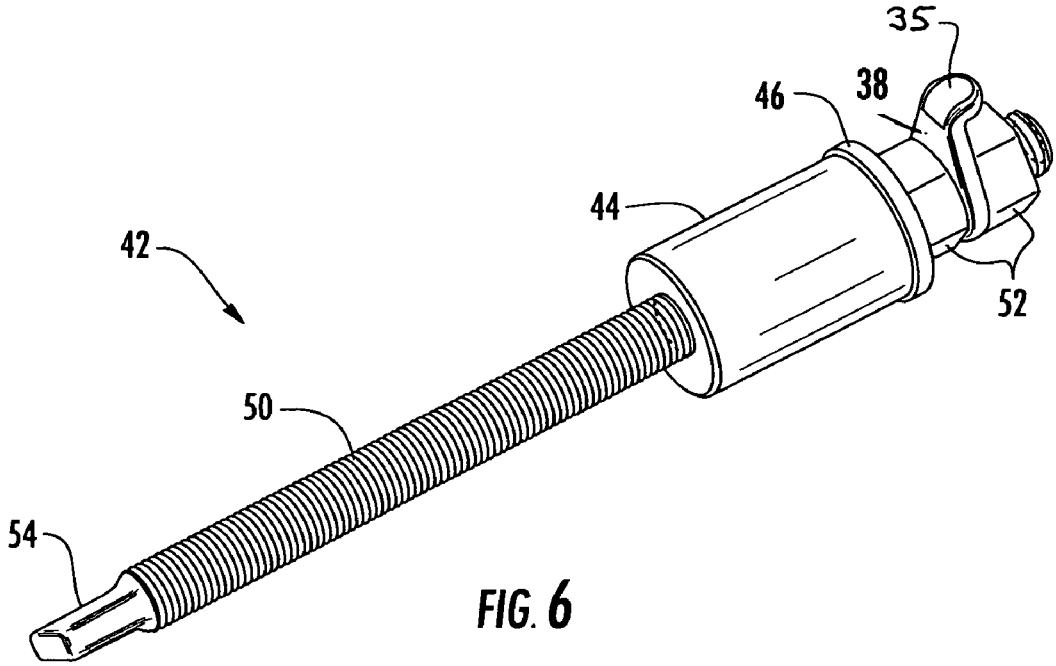
FIG. 6 is a perspective view of the fine adjustment mechanism.
Figure 7:
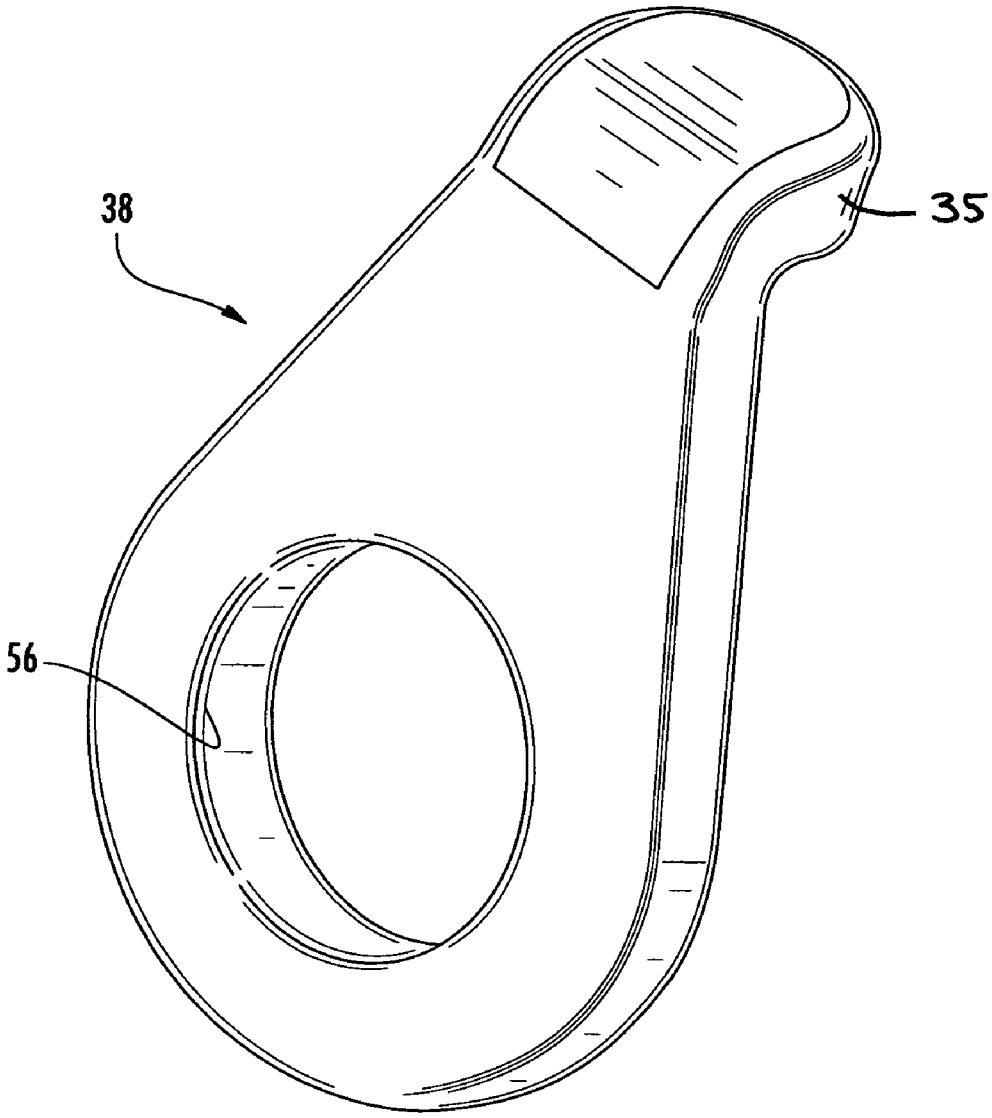
FIG. 7 is a perspective view of locking finger of the fine adjustment mechanism.

Referring now to FIG. 5-7, the fine adjustment mechanism 42, for further changing the length of the adjustable support rod 12, is shown. In order to fit the tool-less double rod 10 within the opposing vertical interior sides of window casements of varying sizes, the adjustable support rod 12 also needs to be finely adjustable in addition to being grossly adjustable. The fine adjustment mechanism, or means for finely adjusting, 42 is shown in FIG. 6 and includes a ferrule 44 with a flange 46 and a threaded aperture 48 therethrough. Threaded rod 50 is received within the threaded aperture 48 of ferrule 44. A locking finger 38 is trapped between two nuts 52 on the end of the threaded rod 50. The locking finger 38 may be further reinforced with a backing plate (not shown) to stiffen the finger 38. As shown, finger 38 extends radially outwardly and terminates in a folded tab 35 engages the outer tubular part at an aperture 36.

The threaded rod 50 also includes a stop 54 to prevent the threaded rod 50 from being extracted from the aperture 48 on the ferrule 44. One way to form the stop 52 is by flattening the end of the threaded rod 50 by stamping it. Another structure, such as a nut, may also be fastened to the end of the threaded rod to form the stop 52. The locking finger 38 is best shown in FIG. 7 and includes a central aperture 56 for receiving the threaded rod 50 and a tab 35 which is sized to fit into an aperture 36 of outer tubular portion 32.

Referring back now to FIG. 5, the ferrule 44 is received within the inward facing end of the inner tubular portion 34 with the flange 46 forced against an outer edge of the inward facing end 34. The flange 46 on the ferrule 44 prevents the ferrule 44 from being forced into the inner tubular portion 34. Because the threaded rod 50 is received within the threaded aperture 48 on the ferrule 44, tightening or loosening direction rotation of the ferrule and thus the tubular portions relative to each other, effectively lengthens or shortens the distance the locking finger 38 is positioned from the inward facing end of the inner tubular portion 34.

To fit the tool-less curtain rod 10 within a window casement, the user slidably adjusts the inner tubular portion 34 within the outer tubular portion 32, to make the gross adjustment, until the overall length of the adjustable support rod is about the size of the window casement. In doing that, the user fits the locking finger 38 into the nearest aperture 36 on the outer tubular member 32 that correlates to the desired size of the window casement. The user then fits the left bracket 14 and right bracket 14 onto the outward facing ends of the tubular portions 32, 34 of the adjustable support rod 12 and holds the adjustable support rod 12 at the desired installation location within the window casement. After the user has positioned the adjustable support rod 12 within the window casement, the user rotates or twists the inner tubular portion 32 in the appropriate direction, making the threaded rod 50 to move out of the ferrule 44, so the tubular members 32, 34 move outwardly and so the adjustable support rod 12 is lengthened and tightened within the window casement. Twisting the inner tubular portion 32, thereby twisting threaded rod 50 into the ferrule 44, in the opposite direction loosens the adjustable support rod 12 and allows the tool-less curtain rod to be removed from the window casement. Because the user can tighten the tool-less curtain rod 12, the user can apply sufficient pressure to prevent the tool-less curtain rod from slipping or falling out of the window casement.

Figures 8A, 8B:
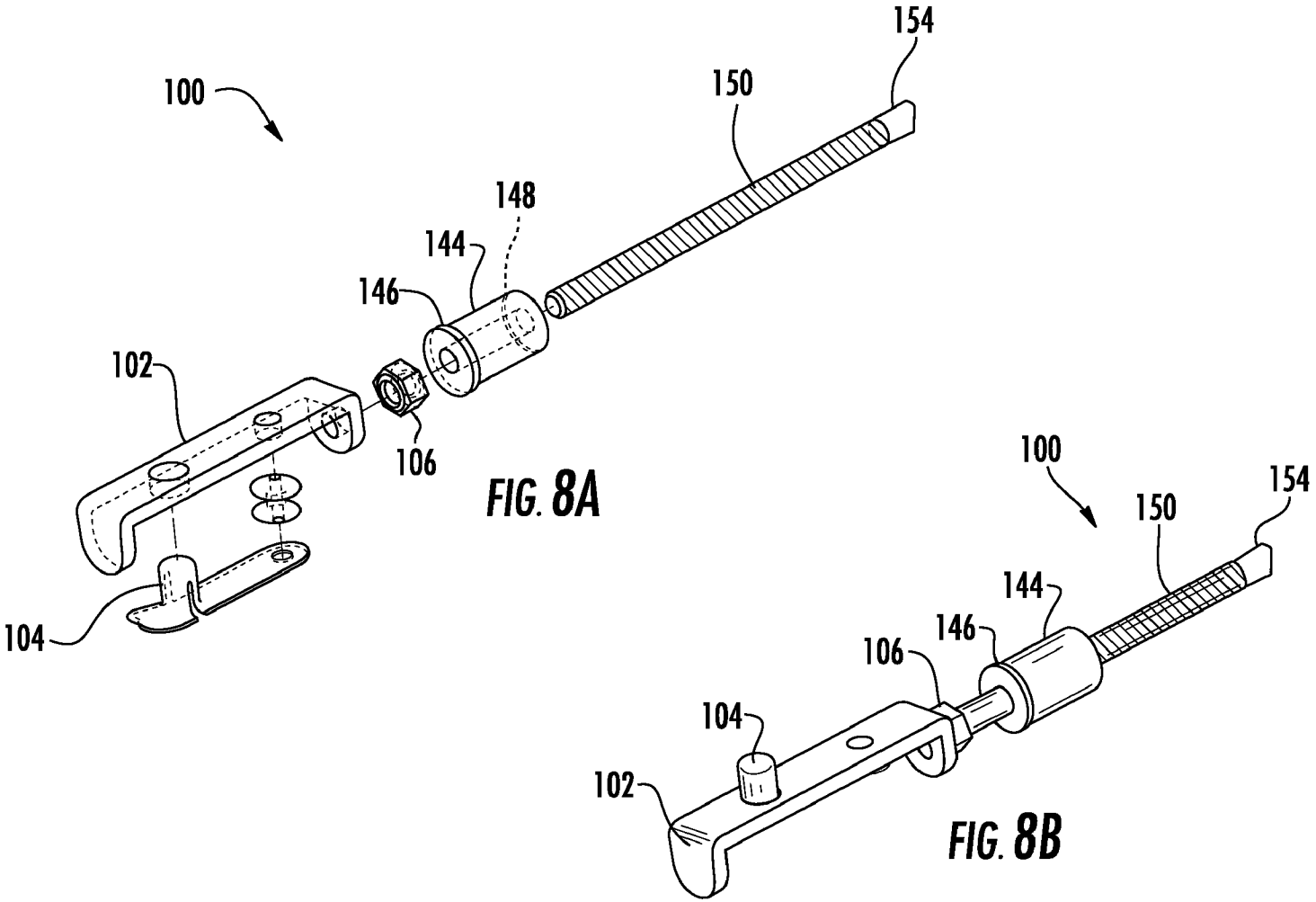
FIG. 8 is an alternative embodiment of the fine adjustment mechanism, which includes a spring-button.

Referring now to the exploded view of FIG. 8A and the assembly view of FIG. 8B, an alternative embodiment fine adjustment mechanism 100 is shown. Like the preferred embodiment 42 shown in FIG. 6, the alternative embodiment 100 includes a ferrule 144 with a flange 146, a threaded aperture 148 and a threaded rod 150 received therein. The threaded rod 150 also includes a stop 154 as well. Also like the preferred embodiment 42, the threaded rod 150 of the alternative embodiment 100 may be shortened and lengthened by threading the threaded rod 154 into the or out of the ferrule 144 as desired. The primary difference between the two embodiments of means for finely adjusting 42, 100, is that spring-button holder 102, which is connected to the end of the threaded rod 150 by a nut 106, replaces the body of locking finger 38 of the preferred embodiment 42; and that spring button 104, which is attached to holder 102, replaces tab 35 of finger 38. Spring button 104 selectively engages one of the apertures 36 on the outer tubular member 32 to lock the adjustable support rod 12 at a desired length. Thus, both embodiments comprise a structure which extends radially outwardly to connect the threaded rod (and thus indirectly the ferrule and outer end of the inner tubular part) to outer tubular part by means of a portion which fits within an aperture of the outer tubular part.

Therefore, it can be seen that the present invention provides a unique solution to the problem of providing a tool-less curtain rod assembly that does not require a spring-tension rod and alleviates the problem of prior art tool-less curtain rods from slipping or falling from the window casement.

It would be appreciated by those skilled in the art that various changes and modifications can be made to the illustrated embodiments without departing from the spirit of the present invention. All such modifications and changes are intended to be within the scope of the present invention.

What is claimed is:

1. A curtain rod assembly for use within a window casement comprising:

two spaced apart brackets, each for contacting an opposing side of the window casement and for receiving an end of an adjustable support rod, each having a first casement-contacting portion and a portion for receiving the outer end of a tubular part of an adjustable support rod;

an adjustable support rod, running between said brackets, for pushing the brackets outwardly against said opposing window casement sides, comprised of a. a first tube, having an outer end engaged with a first of said brackets, the tube extending a portion of the distance between the brackets to an inner end;

b. a second tube, having an outer end engaged with the second bracket, the tube extending a portion of the distance between the brackets to an inner end; wherein, the inner end of the second tube is slidably positioned for selective lengthwise movement within the bore of the inner end of the first tube, to thereby form a telescoping tubular rod subassembly;

c. gross change means, for increasing or decreasing the length of said tubular rod by discrete increments, comprising structure connecting the inner end of the second tube to the first tube by engaging the first tube at one of a plurality of lengthwise-spaced apart apertures in the first tube; and, d. fine adjustment means for increasing the length of the tubular rod subassembly from that which is provided by said gross change means, positioned in part within the inner end of said second tube, wherein said fine adjustment means shares comprises said connecting structure with gross change means.

2. The curtain rod assembly of claim 1 wherein said means for making fine adjustment comprises a ferrule positioned within the inner end of the second tube and a threaded rod running through a threaded aperture in the ferrule, wherein an end of the threaded rod is fastened to said connecting structure.

3. The curtain rod assembly of claim 2 wherein said means for making gross adjustment comprises a finger mounted on said threaded rod and extending radially outwardly within said first tube, the finger having a tab for engaging one of said apertures.

4. The curtain rod assembly of claim 2 wherein said connecting structure comprises a holder and button combination, mounted on said threaded rod and extending radially outwardly within said first tube, wherein the button is shaped for engaging one of said apertures.

5. The assembly of claim 1, wherein each bracket further comprises: a second casement-contacting portion running at a right angle to said first casement-contacting portion, for engaging a front surface of said window casement.

6. The assembly of claim 1, wherein each of said brackets further comprises: a stabilizer portion extending downwardly from said second casement-contacting portion, for preventing rotation of the bracket in the plane of contact of the first portion.

7. The curtain rod assembly of claim 1 wherein each bracket further comprises a curved hook extending transversely to the length of the adjustable support rod, for receiving a decorative curtain rod.

8. The curtain rod assembly of claim 7, further comprising: a curtain rod, mounted in said curved hooks, the rod running parallel to the adjustable support rod.

9. A curtain rod assembly for use within a window casement comprising:

opposing side brackets, for contacting opposing sides of the window casement and for receiving an end of an adjustable support rod, each bracket having a first casement-contacting portion and a portion for receiving the outer end of a tubular part of an adjustable support rod;

an adjustable support rod, running between said brackets, for pushing the brackets outwardly against said opposing window casement sides, comprised of a. an outer tubular part, having an outer end engaged with a first bracket, the part extending a portion of the distance between the brackets to an inner end;

b. an inner tubular part, having an outer end engaged with the second bracket, the part extending a portion of the distance between the brackets to an inner end; wherein, the inner end of the inner tubular part is positioned within the inner portion of the outer tubular part to form a tubular part subassembly;

c. means for making a gross adjustment in the length of the tubular part subassembly, so the length approximates but is less than the distance between the opposing side window casements, including an outer tubular part having a plurality of lengthwise-spaced apart apertures; and, structure connecting the inner end of the inner tubular part to the outer tubular part at the location of one of said apertures;

d. means for making fine adjustment in the length of the tubular part subassembly, to increase said length beyond the length which results from making a gross adjustment, comprising a ferrule positioned within the inner end of the inner tubular part in combination with a threaded rod running through a threaded aperture in the ferrule, wherein an end of the threaded rod is adjustably connected to the outer tubular part by said structure, and wherein making the fine adjustment causes the tubular parts to push outwardly relative to each other and against their respective brackets.

10. The curtain rod assembly of claim 9 wherein said structure comprises a finger having a tab for engaging one of said apertures, and wherein the means for making a gross adjustment and the means for making fine adjustment share said structure.

* * * * *